US006697036B2

(12) United States Patent
Yamada et al.

(10) Patent No.: US 6,697,036 B2
(45) Date of Patent: Feb. 24, 2004

(54) LIQUID CRYSTAL CONTROL DEVICE TO PROVIDE A UNIFORM DISPLAY OR EXPOSURE ON A DISPLAY DEVICE

(75) Inventors: Keiki Yamada, Tokyo (JP); Ichiro Furuki, Tokyo (JP); Hiroshi Ito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 233 days.

(21) Appl. No.: 09/816,327

(22) Filed: Mar. 26, 2001

(65) Prior Publication Data

US 2002/0024509 A1 Feb. 28, 2002

(30) Foreign Application Priority Data

Aug. 25, 2000 (JP) ..... 2000-255520

(51) Int. Cl.[7] ..... G09G 3/36
(52) U.S. Cl. ..... 345/87; 345/101
(58) Field of Search ..... 345/87, 88, 89, 345/102, 101, 98, 175; 349/106, 33, 34; 347/232, 237, 238, 248, 247

(56) References Cited

U.S. PATENT DOCUMENTS 4,859,034 A * 8/1989 Shiraishi et al. ..... 349/3
5,047,789 A * 9/1991 Kanayama et al. ..... 347/232
5,128,773 A * 7/1992 Sato ..... 386/42
5,548,423 A * 8/1996 Natsunaga ..... 349/106
6,091,405 A * 7/2000 Lowe et al. ..... 345/175
6,151,004 A * 11/2000 Kaneko ..... 345/88

FOREIGN PATENT DOCUMENTS

JP A7256928 10/1995

* cited by examiner

*Primary Examiner*—Chanh Nguyen
(74) *Attorney, Agent, or Firm*—Birch, Stewart, Kolasch & Birch, LLP

(57) ABSTRACT

A liquid crystal control device can eliminate instability in a light quantity characteristic of a light source occurring when an operating mode of a liquid crystal shutter is changed, thus provide a stable exposure or display, and realize high-quality picture recording. To this end, a timing at which the light source is turned on by a light source controller is delayed with respect to a timing at which a liquid crystal is driven to operate by a liquid crystal driving section.

16 Claims, 15 Drawing Sheets

K-1 LINE
K LINE
K+1 LINE

LIQUID CRYSTAL CONTROL DEVICE TO PROVIDE A UNIFORM DISPLAY OR EXPOSURE ON A DISPLAY DEVICE

CROSS REFERENCE TO RELATED APPLICATION

This application is based on Application No. 2000-255520 filed in Japan on Aug. 25, 2000, the contents of which are hereby incorporated by reference.

BACKGROUND OF THE INVENTION

1. Field of the Invention

The present invention relates to a liquid crystal control device for exposing light onto a photosensitive member or performing an indication as a display device using a liquid crystal for example, by driving and controlling the liquid crystal.

2. Description of the Related Art

FIG. 15 is a perspective view illustrating the construction of a print head for a conventional liquid crystal drive unit disclosed in Japanese Patent Application Laid-Open No. No. 7-256928 for example.

In FIG. 15, white light from a halogen point light source 100 is separated into red, green and blue light by means of a color liquid crystal shutter 101, and continuously irradiated to an end face of an acrylic rod 102 in a time shifted manner.

Here, note that the acrylic rod 102 is covered with a reflection foil, on which aluminum, etc., is deposited except for a light emitting face thereof, and it has a function of converting incident light entered from an end thereof into linear or line-shaped light to be radiated downward.

Thus, red, green and blue linear light is continuously irradiated to a monochrome shutter array 103 in a time shifted manner.

Within the monochrome shutter array 103, there are three rows of pixels, corresponding to red, green and blue, respectively, which are driven to permit only the light of the colors specified respectively.

For instance, when linear red light in the shape of a line is irradiated, only pixel rows corresponding to red can be passed or penetrated and the other two pixel rows are kept in a blocking state.

Accordingly, the respective linear red, green and blue lights modulated by the monochrome shutter array 103 are focused on a photosensitive paper 105 by means of a SELFOC lens array 104 (i.e., tradesman of a converging lens array).

At this time, the respective red, green and blue linear lights are sequentially exposed to the photosensitive paper 105 at the same place thereof through a relative movement of the photosensitive paper 105 to the monochrome liquid crystal shutter array 103, so that a two-dimensional print image can be obtained.

With the conventional print head for a liquid crystal drive unit, photosensitive paper is exposed in the above manner to form a gradation or halftone image thereon.

In order to speed up the printing, for two above-mentioned kinds of liquid crystal shutters (i.e., the liquid crystal shutter 101 and the monochrome shutter array 103), there have generally been employed STN (super twisted nematic) type liquid crystal, ferroelectric liquid crystal, etc., which can respond at high speed in the unit of milliseconds by applying thereto an AC voltage of ten kHz or so.

On the other hand, the display with a liquid crystal shutter is called an LCD (Liquid Crystal Display). This is constructed such that a liquid crystal is inserted between two glass substrates in the form of an upper and a lower glass substrate with a distance therebetween of about 5 $\mu$m, and a spacer is disposed between the upper and lower glass substrates so as to prevent them from coming in contact with each other. In addition, a polarizing plate is generally set up on each of the upper and lower glass substrates in such a manner that the direction of vibration of one of the polarizing plate is at right angles with respect to that of the other. The Liquid crystal has a property that upon application of an electric field thereto, the arrangement of molecules therein is varied according to the electric field. Therefore, for example, the liquid crystal can be controlled in such a manner that it allows light to penetrate therethrough upon application of a voltage, but intercept or block light when there is no voltage supplied to them. In addition, colors of half tones can be expressed by changing the penetration of light through the strength of the voltage applied.

As a method for driving the liquid crystal, first striped transparent electrodes are installed on the upper glass substrate in the direction of X, and second striped transparent electrodes are installed on the lower glass substrate in the direction of Y. According to a matrix driving technique as one example, a voltage is imposed to the points of intersection where a selected electrode in the X direction intersect with a selected electrode in the Y direction, to thereby control the amount of light penetrating through the liquid crystal. According to an active matrix driving technique as another example, a transistor is disposed at each of the intersections between the electrodes in the X direction and the electrodes in the Y direction, with electric current being accumulated in the transistors lying at those portions which form pixels.

Moreover, display techniques used for a display include a penetration type and a reflection type display technique. According to the penetration type display technique, back lights are disposed under the liquid crystal so that the light emitted from the back lights penetrates through the liquid crystal to thereby provide a display or indication. On the other hand, according to the reflecting type display technique, a reflection plate is placed under the liquid crystal with which light is reflected at the bottom or lower side thereof so as to give a display.

With the conventional liquid crystal control device as described above, two operational modes including a light-penetrating or transparent mode and a light-blocking mode are alternatively changed from one to the other to form a gradation or gray-scale image by utilizing the specific property of the liquid crystal in which upon application of a voltage, molecules of the liquid crystal are caused to change their arrangement along the direction of an electric field generated. However, there arise the following problems. That is, in the case of a positive type liquid crystal, immediately after the liquid crystal has changed from the light-blocking mode to the light-penetrating or transparent mode, there would develop a condition in which the liquid crystal is not stabilized due to a backflow (i.e., spring phenomenon), so no uniform exposure or display could not be obtained. Accordingly, in cases where exposure is carried out to a photosensitive member, the exposure becomes unstable and hence any high quality picture record cannot be achieved, with the result that it is difficult to provide a uniform display with a display device.

SUMMARY OF THE INVENTION

The present invention is intended to obviate the above-mentioned problems and has for its object to provide a liquid crystal control device which is capable of obtaining a uniform exposure or a uniform display.

According to one aspect of the present invention, there is provided a liquid crystal control device comprising: a light source controller for controlling the turning on and off of a light source; a liquid crystal driving section for driving a liquid crystal; and a control unit for delaying a timing, at which the light source is turned on by the light source controller, with respect to a timing, at which the liquid crystal is driven to operate by the liquid crystal driving section.

According to another aspect of the present invention, there is provided a liquid crystal control device comprising: a light source controller for controlling the turning on and off of a light source; a liquid crystal driving section for driving a liquid crystal; and a control unit for delaying a timing, at which the light source is turned off by the light source controller, with respect to a timing, at which the liquid crystal is driven to operate by the liquid crystal driving section.

In a preferred form of the invention, the control unit adjusts the timing, at which the light source is turned on by the light source controller, according to a temperature characteristic of the liquid crystal.

According to a further aspect of the present invention, there is provided a liquid crystal control device comprising: a light source controller for controlling the turning on and off of a light source; a liquid crystal driving section for driving a liquid crystal; and a control unit for controlling a timing, at which the light source is turned on by the light source controller, and a timing, at which the liquid crystal is driven to operate by the liquid crystal driving section; wherein the light source controller controls the light source in such a manner that a quantity of light emitted by the light source gradually increases when the light source is turned on.

According to a still further aspect of the present invention, there is provided a liquid crystal control device comprising: a light source controller for controlling the turning on and off of a light source; a liquid crystal driving section for driving a liquid crystal; and a control unit for controlling a timing, at which the light source is turned on by the light source controller, and a timing, at which the liquid crystal is driven to operate by the liquid crystal driving section; wherein the light source controller controls the light source in such a manner that the light source emits light in a pulsed manner when turned on.

In another preferred form of the invention, the light source comprises a light emitting type element.

In a further preferred form of the invention, the thickness of a liquid crystal layer of the liquid crystal is 3.0 $\mu$m or less.

In a still further preferred form of the invention, the liquid crystal comprises a positive type TN liquid crystal.

The above and other objects, features and advantages of the present invention will be more readily apparent to those skilled in the art from the following detailed description of preferred embodiments of the invention taken in conjunction with the accompanying drawings.

DESCRIPTION OF THE PREFERRED EMBODIMENTS

Embodiment 1

Figure 1:
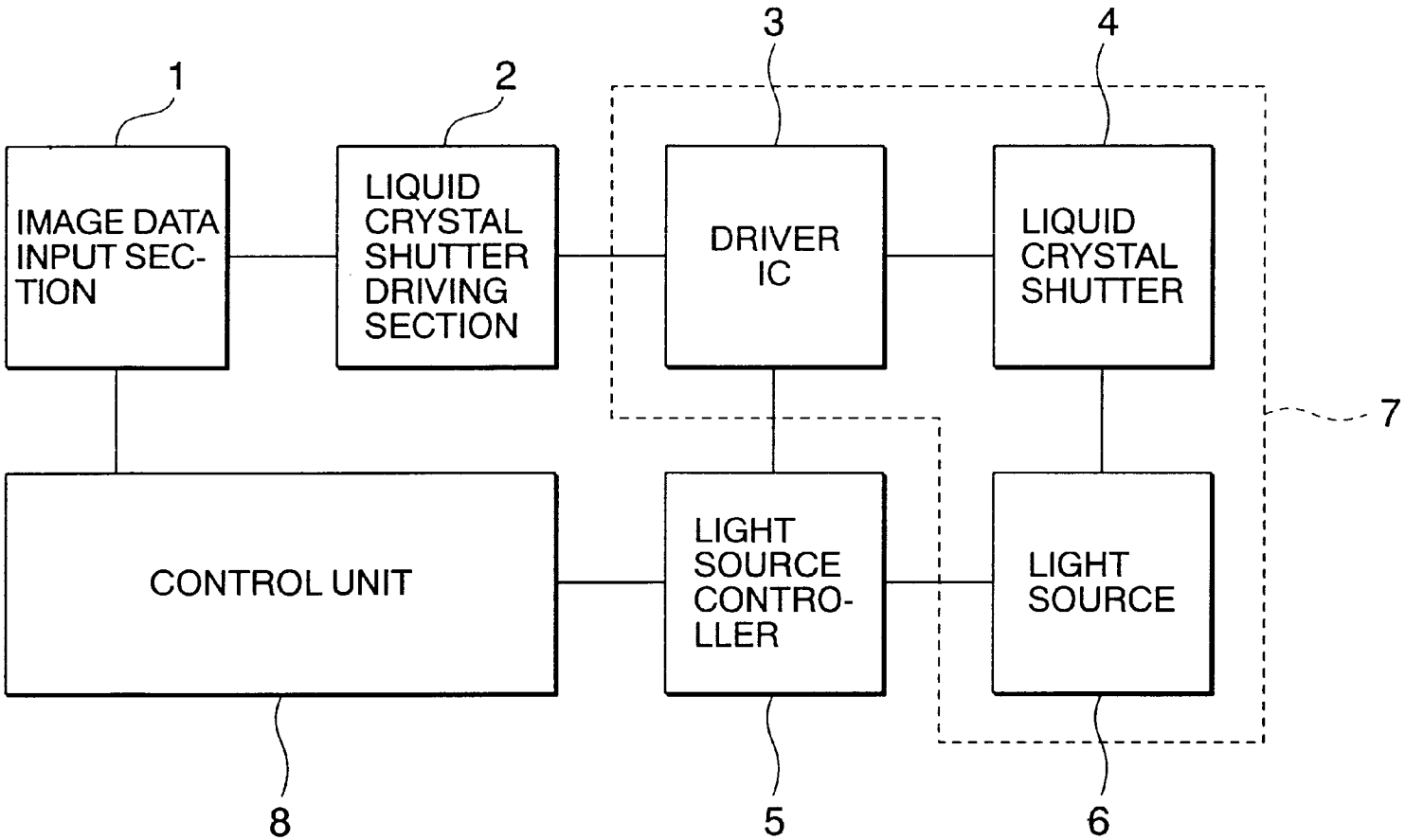
FIG. 1 is a block diagram which shows the construction of a liquid crystal control device according to the present invention.

FIG. 1 is a block diagram illustrating the construction of a liquid crystal control device according to an embodiment 1 of the present invention.

In this figure, reference numeral 1 designates an image data input section for inputting image data. For instance, an image data in the form of a gradation data is input to image data input section 1 from an external host computer, a portable terminal, etc., (not shown).

The gradation data comprises a value ranging from '0' to 'n−1' for data of 'n' levels of gradation (i.e., 'n' is an integer of 2 or more), e.g., a value ranging from '0' to '255' for data of 256 levels of gradation, a value ranging from '0' to '63' for data of 64 levels of gradation, etc.

Reference numeral 2 designates a liquid crystal driving section in the form of a liquid crystal shutter driving section which generates and outputs print head driving data based on the image data output from the image data input section 1.

For instance, in the case where a print head, generally designated at 7, is a binary print head, only binary data of a record and a non-record can be input and hence the time of exposure is adjusted so as to exhibit a half tone by changing the ratio of a record time to a non-record time at a predetermined point in time.

In this case, the liquid crystal shutter driving section 2 calculates the exposure time based on the input image data, and outputs the print head driving data which is the ratio of a record time to a non-record time corresponding to the exposure time, whereby the exposure time is properly adjusted to exhibit the color of the half tone.

For instance, the longer exposure time results in the darker color, and the shorter exposure time gives the lighter color.

On the other hand, in the case where the print head 7 is of the multi-value type, it can have multi-value data input thereto and perform by itself the processing for exhibiting half tones, and thus the image data output from the image data input section 1 is transmitted to the print head 7 as it is.

In either of the above cases, the liquid crystal shutter driving section 2 controls the interface to the print head 7, for example, clock signals, latch signals, etc., in accordance with the timing of the print head 7.

As a method for driving the print head 7, exposure is effected in the unit exposure time (e.g., a period of 1 μs–300 μs or so) for each tone or gradation so that the print head 7 is driven to operate so as to provide a linear gradation property.

A driver IC 3 drives a liquid crystal shutter 4 composed of one row of liquid crystal shutter elements for instance.

A light source controller 5 controls a source of light 6 composed of a light emitting diode (LED), an electronic luminescence (EL), etc., for instance.

The print head 7 is composed of the driver IC 3, the liquid crystal shutter 4 and the source of light 6.

Figure 2A:
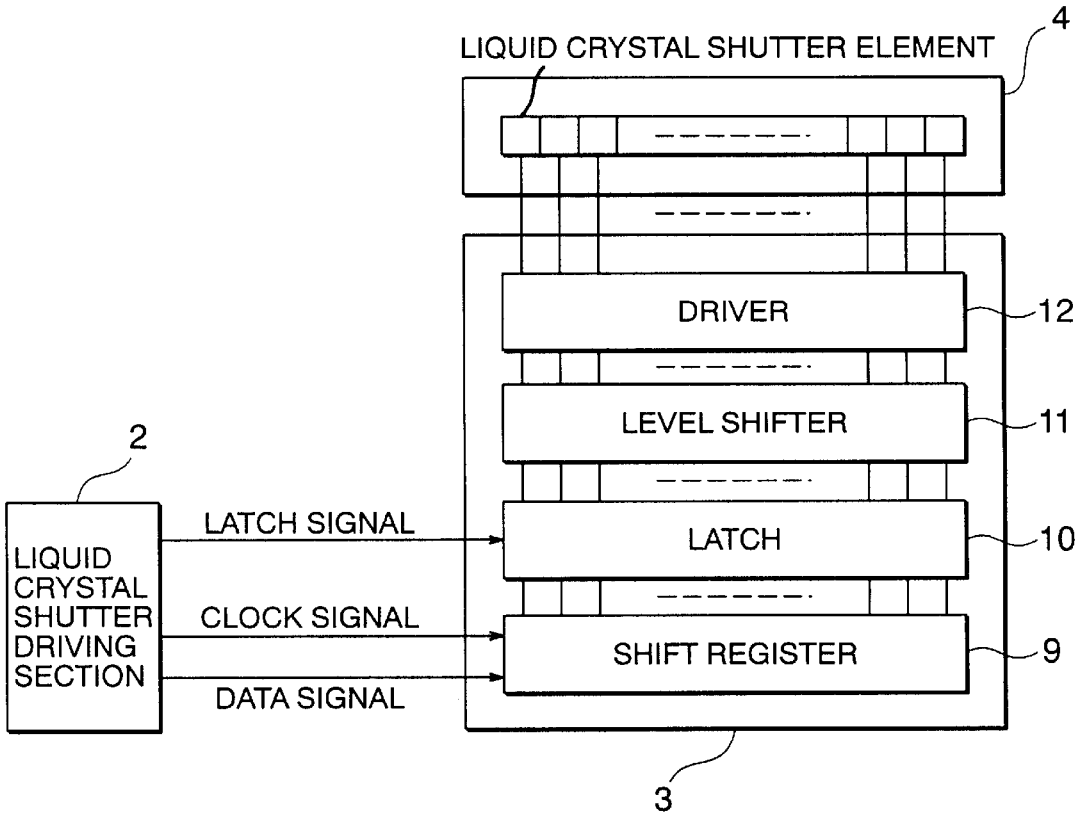
FIG. 2A is a block diagrams illustrating the construction of a print head according to the present invention.

In FIG. 2A, the driver IC 3 is composed of a shift register 9, a latch 10, a level shifter 11, and a driver 12. The shift register 9 sequentially shifts data for the print head according to the clock pulse from the liquid crystal shutter driving section 2. The print head data is taken into the latch 10 according to a latch signal. The data thus latched is converted into a desired voltage by means of the level shifter 11, whereby the liquid crystal shutter elements in the liquid crystal shutter 4 are driven to operate by way of the driver 12.

Figure 2B:
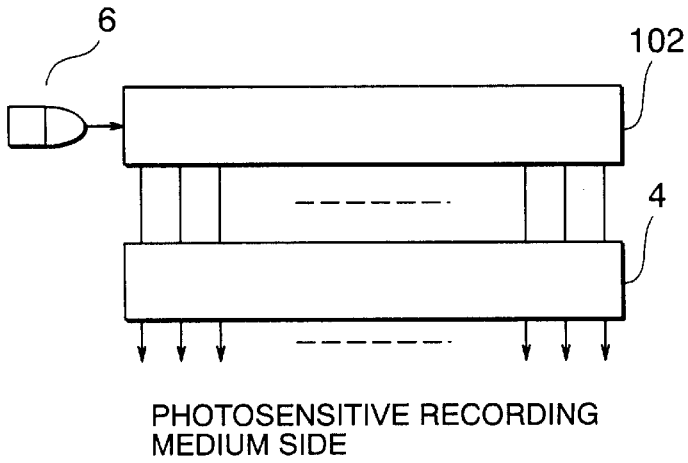
FIG. 2B is a side elevation of an acrylic rod and a liquid crystal shutter.

On the other hand, FIG. 2B is a side elevation illustrating the construction of a light receiving portion through which the light from the light source 6 enters the liquid crystal shutter 4. The light from the light source 6 is converted into a linear or line-shaped light by means of the acrylic rod 102, and then irradiated to the liquid crystal shutter 4. The liquid crystal shutter 4 is driven by the operation of the driver IC 3 to perform a desired exposure.

For instance, the liquid crystal shutter 4 comprise 640 liquid crystal shutter elements which are arranged in a line. For instance, the liquid crystal shutter elements comprises two glass substrates with a liquid crystal of TN (twisted nematic) type sealingly enclosed therebetween. In this liquid crystal shutter, polarizing plates are arranged outside of the two glass substrates, respectively. The liquid crystal shutter includes a positive and a negative type depending on the arrangement or configuration of the absorption axes of the polarizing plates. The penetration/interception of light can be controlled by adjusting the period of time during which a voltage is imposed on the liquid crystal shutter, as a result of which the exposure time can be properly controlled so as to form an image with a tone or gradation.

The construction of the liquid crystal shutter elements of the positive type indicates such a construction that two polarizing plates are arranged with their absorption axes being shifted by 90 degrees with respect to each other, so that light can pass or penetrate through the liquid crystal shutter elements (i.e., a state of penetration) when a voltage is not applied to them, but light is intercepted and can not pass therethrough (i.e., a state of interception) upon application of a voltage thereto.

On the other hand, the construction of the liquid crystal shutter elements of the negative type indicates such a construction that two polarizing plates are arranged with their absorption axies being disposed in a parallel relation with respect to each other, so that light enters light is intercepted and can not pass the liquid crystal shutter elements (i.e., the state of interception) when no voltage is applied to them, whereas light can pass or penetrate therethrough (i.e., the state of penetration) upon application of a voltage thereto.

However, the liquid crystal shutter elements of the positive type is relatively large in the light transmittance in the state of interception as compared with the negative type, and hence has low contrast and poor gradation. Therefore, the positive type is desirable for the print head 7.

There are various kinds of liquid crystals, including nematic liquid crystals of the TN type, the STN type, etc., cholesteric liquid crystals, or smectic liquid crystals represented by ferroelectric liquid crystals.

The desired characteristics of the print head 7 mounted on an exposure apparatus are as follows: the contrast ratio is high; the response speed of each liquid crystal shutter element is high; the driving voltage is low; and the shock resistance is stable, etc. As a result of comprehensive evaluations of these items for the desired characteristics of the print head 7, it was experimentally concluded that the TN type liquid crystals are most preferable.

For instance, the TN type liquid crystals were not less than ten times more excellent in the contrast ratio than the STN type liquid crystals, and the TN type liquid crystals were more stable in the shock resistance than the smectic liquid crystals.

In FIG. 1, a control unit 8 controls the image data input section 1, the liquid crystal shutter driving section 2, and the light source controller 5 of the liquid crystal control device. The control unit 8 is composed of a microprocessor, electric circuits, memories, etc., as necessary.

Here, note that the control unit 8 communicates with an external host computer (not shown) and the like via physical interfaces, etc., according to prescribed procedures for inputting and outputting various data (e.g., the number of pixels, image data, etc.).

Here, note that for such physical interfaces, there can be used wired interfaces including existing Centronics-compatible parallel interfaces, serial interfaces such as RS 232 C interfaces, IEEEs1394 interfaces, universal serial buses (USB), etc., and wireless interfaces such as infrared (IR) communications interfaces, Bluetooth interfaces, etc.

Next, description will be made of an exposure method employed in the present invention while referring to using FIGS. 3A through 3D.

FIGS. 3A through 3D are explanatory views illustrating the exposure method of the present invention.

Figures 3A, 3B, 3C, 3D:
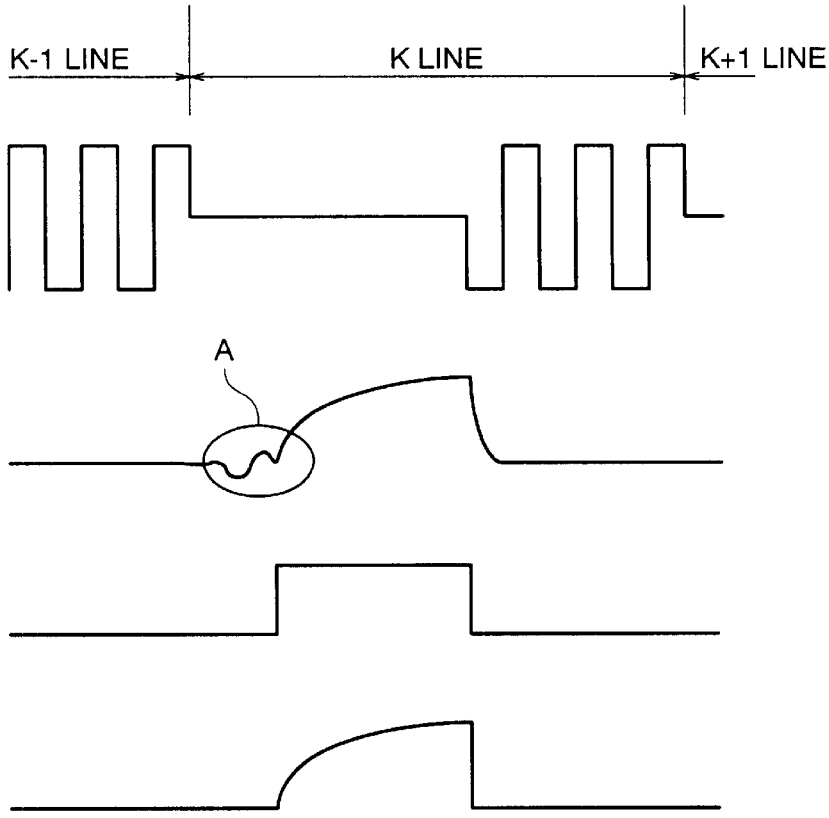
FIGS. 3A through 3D are explanatory views illustrating an exposure method of the liquid crystal control device according to the present invention.

FIG. 3A shows a voltage waveform imposed on the liquid crystal shutter element.

Where the liquid crystal shutter is of the positive type, it is in a blocking or interception mode when a voltage of AC waveform is imposed on the liquid crystal shutter, and it turns into a transparent or reflection mode when the imposed voltage is released.

Here, note that the time or duration of the transparent mode is equal to the exposure time, so a halftone image can be formed by setting the exposure time to a value corresponding to the value of the image data.

FIG. 3B shows the characteristic of the quantity of light in the case when the timing of lighting the light source 6 and the timing of driving the liquid crystal shutter elements, i.e., the timing of making the liquid crystal elements into the transparent or reflection mode, are matched to each other.

For the light source 6, there is employed a self-chromophoric or light emitting type element (i.e., element capable of emitting a color or light on its own) such as an LED, an EL, etc., but not a halogen lamp which has a response characteristic on the order of seconds. An on/off response characteristic in this case is far much faster than the response characteristic of the liquid crystal.

For instance, the on/off response characteristic of the light source in the form of a light emitting type element such as of an LED, an EL, et., is on the order of nanoseconds, whereas the response characteristic of the liquid crystal is on the order of microseconds to milliseconds.

Accordingly, when the timing at which the light source 6 is lit is matched to the timing at which the liquid crystal shutter elements is driven to operate, i.e., the timing the liquid crystal elements are placed into the transparent or reflection mode, the light source 6 starts up at once. On the other hand, the response characteristic of the liquid crystal shutter 4 is slow, so the transient state the liquid crystal shutter 4 will be directly reflected on the light quantity characteristic thereof.

The liquid crystal is caused to change between two modes comprising the transparent or reflection mode and the blocking or interception mode, by virtue of a "twist phenomenon" developed by the application and the release of a voltage. In the case of the positive type liquid crystal as illustrated in FIGS. 3A through 3D, the liquid crystal is made into an unstable state due to a backflow (i.e., spring phenomenon) immediately after a shift from the blocking mode to the transparent mode, and thereafter, this state gradually turns into the transparent state. As a result, the characteristic of the quantity of light passing through the liquid crystal fluctuates as shown FIG. 3B, thus giving rise to a state in which the quantity of light is made unstable under the influence of the backflow. Thereafter, the quantity of light increases gradually. In addition, the positive type liquid crystal has a characteristic that the quantity of light decreases with application of a voltage.

As described above, when the timing at which the light source 6 is lit is matched to the timing at which the liquid crystal shutter elements are driven to operate, the light source 6 has already been lit to supply light from the time at which the operating state of the liquid crystal had not yet become stabilized. Consequently, the quantity of light passing through the liquid crystal is not stabilized owing to the instability of the liquid crystal so that the exposure condition becomes unstable, thus deteriorating the quality of the picture reproduced.

To avoid this, the timing at which the light source 6 is lit is controlled in a manner as shown in FIG. 3C. Specifically, the timing at which the light source 6 is lit is delayed with respect to the timing at which the liquid crystal shutter elements are driven to operate, i.e., the transparent or reflection mode. As a result, the period in which light is supplied from the light source 6 starts at a time later than the period in which the state of the liquid crystal is unstable. Therefore, the operation of the light source 6 during the period in which the liquid crystal is unstable does not affects the light quantity characteristic of the light passing through the liquid crystal, thereby providing a stable light quantity or exposure characteristic, as depicted in FIG. 3D.

Here, it should be noted that the period in which the state of the liquid crystal is unstable varies depending upon the voltage imposed on each liquid crystal shutter element, the material thereof, the environmental temperature, the historical state (i.e., the exposure time of the previous line), etc. Thus, the time for which the lighting of the light source 6 is delayed is determined by experiments or calculations. The time of delay in the range from several microseconds to several milliseconds is preferable.

Now, the operation of this embodiment will be explained with reference to FIG. 1.

First, the image data input to the image data input section 1 is sent to the liquid crystal shutter driving section 2, which then generates the data for driving the liquid crystal shutter 4. As shown in FIG. 2, the output of the liquid crystal shutter driving section 2 is forwarded, as a clock signal, a latch signal or the like, to the driver IC 3 of the print head 7, where a gradation image is formed as described above.

Figure 4:
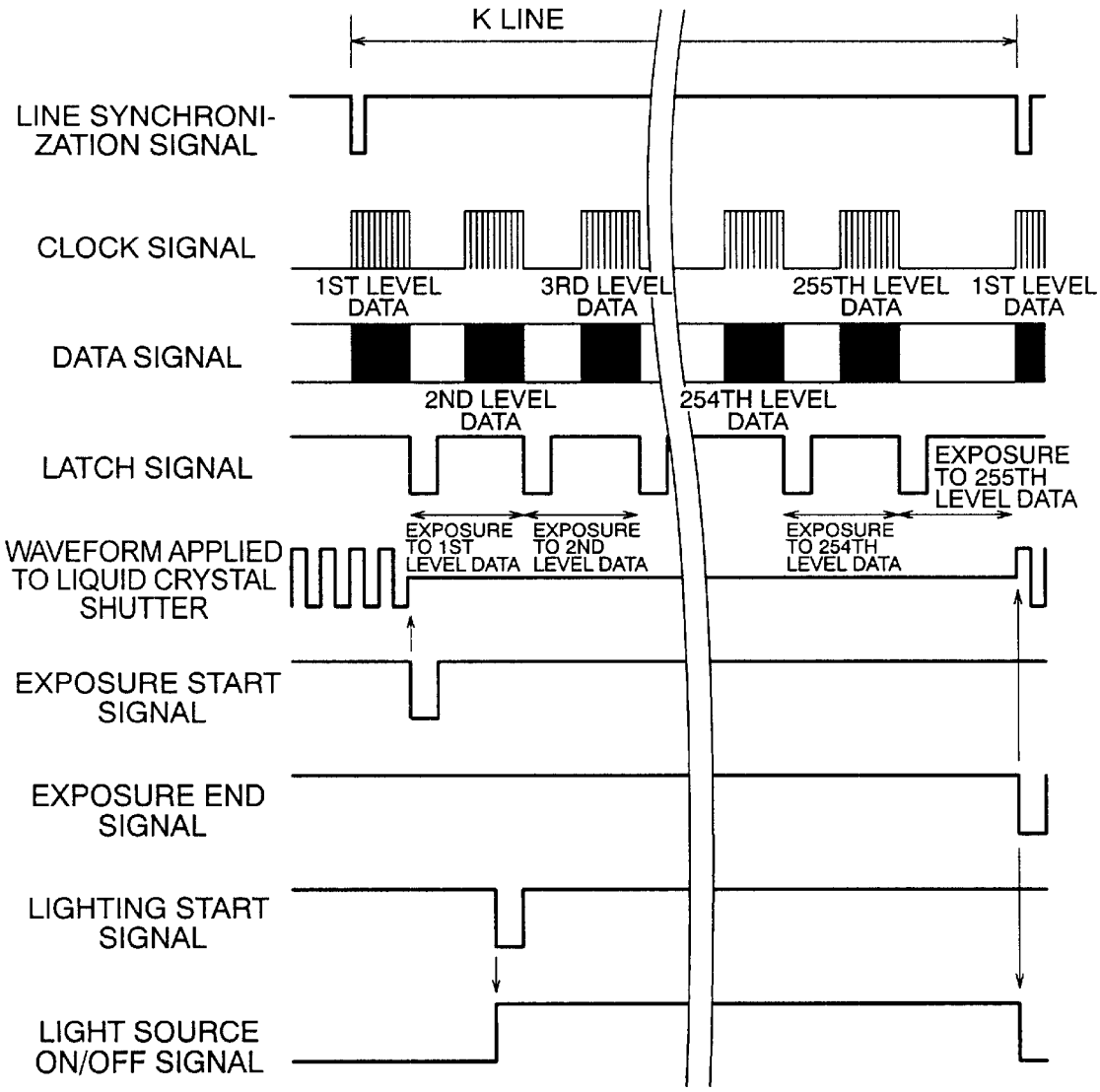
FIG. 4 is an explanatory view illustrating a method for driving the print head according to the present invention.

FIG. 4 is an explanatory view illustrating a method for driving the print head 7.

A line synchronizing signal output from the control unit 8 is to synchronize each line. The pulse interval of the line synchronizing signal corresponds to a recording cycle. This cycle depends on the sensitivity of a photosensitive recording medium, and is in the range from about 0.5 ms to about 3 seconds.

In synchronization with a falling edge of the line synchronizing signal, the liquid crystal shutter driving section 2 outputs a clock signal for the print head 7, and at the same time generates, based on the image data output from the image data input section 1, a binary data signal which takes the value of 0 or 1 only.

For instance, let us assume that the values corresponding to the first line of the image data output from the image data input section 1 are '0', '128', '255', . . . , '1'. This means that the first pixel is a 0-level gradation data; the second pixel is a 128-level gradation data; the third pixel is a 255-level gradation data; . . . , the last pixel is a 1-level gradation data. For the 1-level gradation data, a data signal is output which comprises a series of digits '0', '1', '1', . . . , '1', which are obtained by sequentially comparing '1' for the 1-level gradation with the value of the image data of each pixel. In this case, if the value of the image data is not less than '1', the data signal to be output has '1' for that pixel, and otherwise, it has '0'. After outputting the 1-level gradation data for each pixel, the liquid crystal shutter driving section 2 outputs a latch signal. Then, the liquid crystal shutter driving section 2 releases or removes the voltage applied to each liquid crystal shutter element by means of an exposure start signal from the control unit 8, and performs exposure for the 1-level gradation data.

The same operation is repeated a plurality of times (i.e., 2nd time for the 2-level gradation, . . . , 255th time for the 255-level gradation) within one line, so that exposure is effected on the image data (gradation data) for each pixel. At the time when exposure to the 255th level gradation data has been completed, the application of a voltage to the liquid crystal shutter elements is commenced in synchronization with an exposure end signal, and the exposure processing for one line ends.

The waveform of a voltage applied to the liquid crystal shutter as shown in FIG. 4 illustrates the case that the image data for a certain liquid crystal element is '255' and exposures were carried out from the 1st level gradation to the 255th level gradation (i.e., the case in which application of no voltage to the liquid crystal shutter continued from the 1st level gradation to the 255th level gradation).

On the other hand, a lighting start signal delayed from the exposure start signal from the control unit 8 is generated so that the light source 6 is turned on in synchronization with the lighting start signal, and turned off in synchronization with the exposure end signal.

Figure 5:
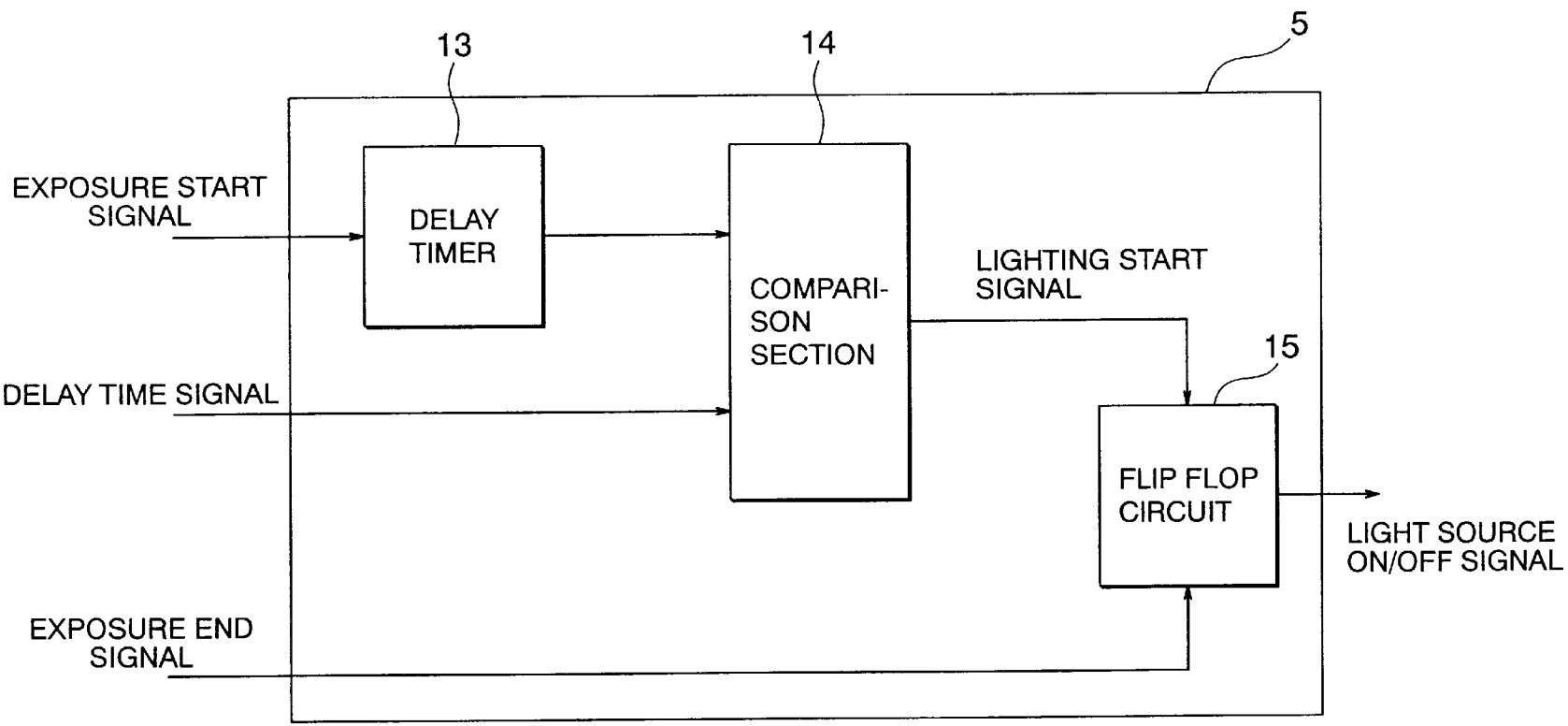
FIG. 5 is a block diagram which shows the construction of a light source controller of the liquid crystal control device of the present invention.

FIG. 5 is a block diagram illustrating the construction of the light source controller 5 which operates to turn on the light source 6 at a timing delayed from the timing at which the liquid crystal shutter is put into the transparent or reflection mode based on control signals (i.e., an exposure start signal and a delay time signal) from the control unit 8. In FIG. 5, a delay timer 13 serves to delay the exposure start signal from the control unit 8. A comparison section 14 compares the output of the delay timer 13 with the delay time signal from the control unit 8. A flip-flop circuit 15 generates an on/off signal for the light source 6 based on the output of the comparison section 14 and the exposure end signal from the control unit 8.

Now, reference will be had to an operation for turning on the light source 6 with reference to FIG. 5.

When an exposure start signal from the control unit 8 is input to the delay timer 13, the delay timer 13 is counted up in synchronization with a clock (not shown).

In addition, the control unit 8 outputs a delay time signal representative of a predetermined delay time, which is input to the comparison section 14 together with the output signal of the delay timer 13, so that the comparison section 14 outputs a lighting start signal to the flip-flop circuit 15 when the delay time signal is matched to the output signal of the delay timer. As a result, the light source on/off signal output from the flip-flop circuit 15 is changed into an on state, whereby the light source 6 is turned.

Subsequently, when the exposure end signal from the control unit 8 is input to the flip-flop circuit 15, the light source on/off signal output from the flip-flop circuit 15 is changed into an off state, whereby the light source 6 is turned off.

In this manner, the formation of the image on one screen is completed by repeating the operations for each line according to the method of delaying the timing, at which the light source 6 is turned on by the light source controller 5, with respect to the timing at which the liquid crystal shutter 4 is driven or energized by the liquid crystal shutter driving section 2, that is, the timing at which the liquid crystal shutter 4 is turned into a transparent or reflection mode.

As described above, this embodiment 1 is constructed such that the timing at which the light source 6 is turned on is delayed with respect to the timing at which the liquid crystal shutter 4 is driven to turn into a transparent or reflection mode. Thus, the following advantages can be provided. The light from the light source can be supplied through the liquid crystal shutter while avoiding adverse influences of the light on the light quantity characteristic of the light passing through the liquid crystal, which would otherwise result from an unstable state of the liquid crystal immediately after the liquid crystal shutter has been changed from a blocking mode to a transparent mode. As a result, a stable exposure or display can be achieved to provide high quality recording.

Here, it is to be noted that in this embodiment 1, various changes or combinations can be made without departing from the purport of the present invention.

For instance, in order to shorten the data transmission time with an external host computer, an image data storage section may be provided for storing a prescribed amount of image data (e.g., image data for one line, or one screen, etc.).

At this time, such an image data storage section may be a color image data storage section for storing color image data.

Moreover, the color image date may be a set of data comprising red, green and blue, or another set of data comprising yellow, magenta and cyanogen, or any other set of color image data.

In addition, although the latch signal interval is made constant FIG. 4, it may be an interval matched to the characteristic of a photosensitive recording medium.

Further, the data transmitted to the print head 7 may be multi-value data in place of binary data.

Furthermore, in FIG. 5, the comparison section 4 generates a lighting start signal as its output, but a latch signal for the 2nd level gradation may be used as a lighting start signal and there is no particular limitation in this respect. In this case, the delayed time only needs to be set to a value substantially equal to an interval between the 1st level gradation latch signal and the 2nd level gradation latch signal.

Still further, though an exposure end signal is also used as a light source turn-off signal in this embodiment, these signals may be provided separately.

Figure 6:
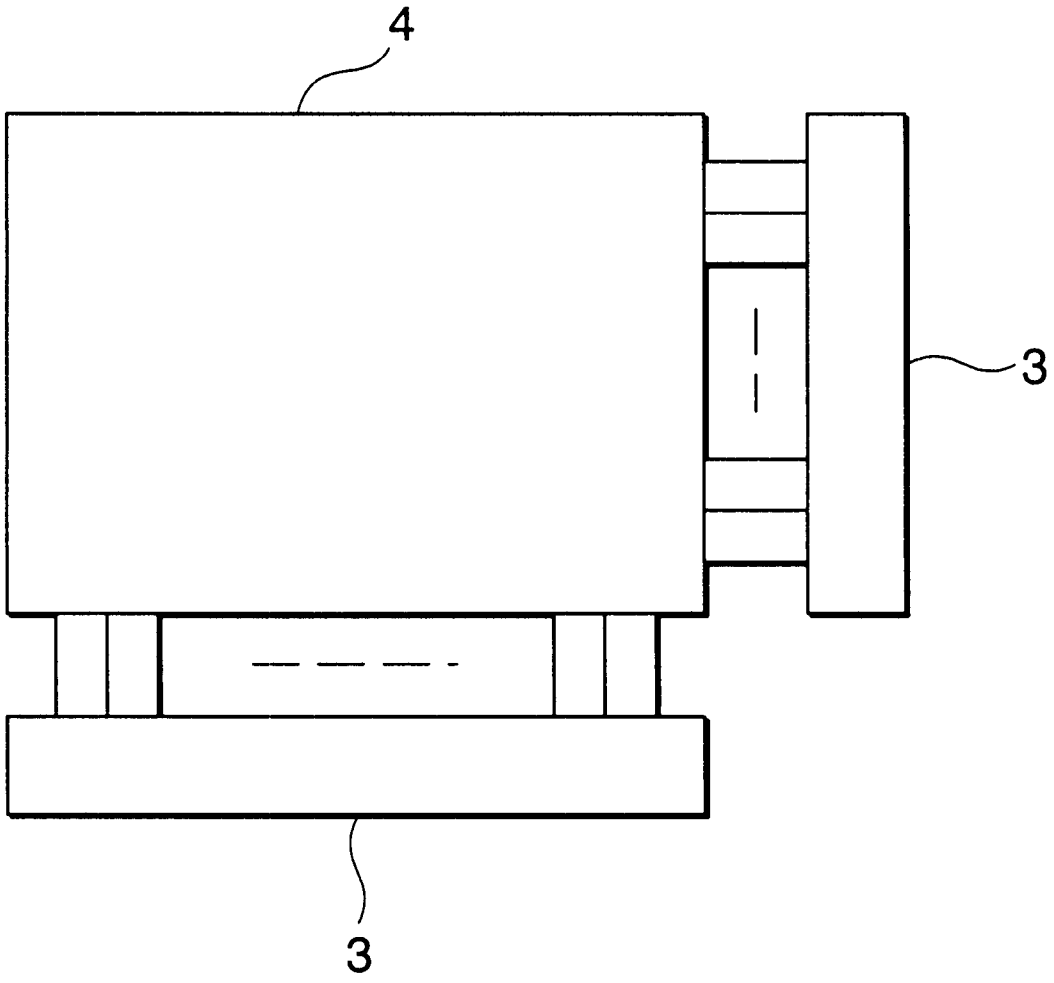
FIG. 6 is a block diagram of a display device using a matrix driving technique.

Besides, although in this embodiment 1, there has been shown and described an example in which the present invention is reduced into practice as an exposure apparatus, the present invention can not only be applied to a display device using a matrix driving technique, as illustrated in FIG. 6, but also to a display device using an active matrix driving technique.

Additionally, though the print head 7 comprises three component elements including the driver IC 3, the liquid crystal shutter 4 and the light source 6, it can be constructed otherwise. That is, the print head 7 may further include, in addition to the above component elements, a combination of the liquid crystal shutter driving section 2, the control unit 8 and the light source controller 5, or another combination of the liquid crystal shutter driving section 2 and the driver IC 3, or a further combination of the liquid crystal shutter driving section 2 and the light source controller 5.

Moreover, though the light source controller 5 is constructed as shown in FIG. 5, it is not limited to such a construction as long as the control unit 8 controls to delay the timing at which the light source 6 is turned on with respect to the timing at which the liquid crystal shutter 4 is turned into the transparent or reflection mode.

Further, a construction or mechanism may be added for reducing or eliminating the influence of a liquid crystalline property on a change in an environmental temperature, etc.

Figure 9:
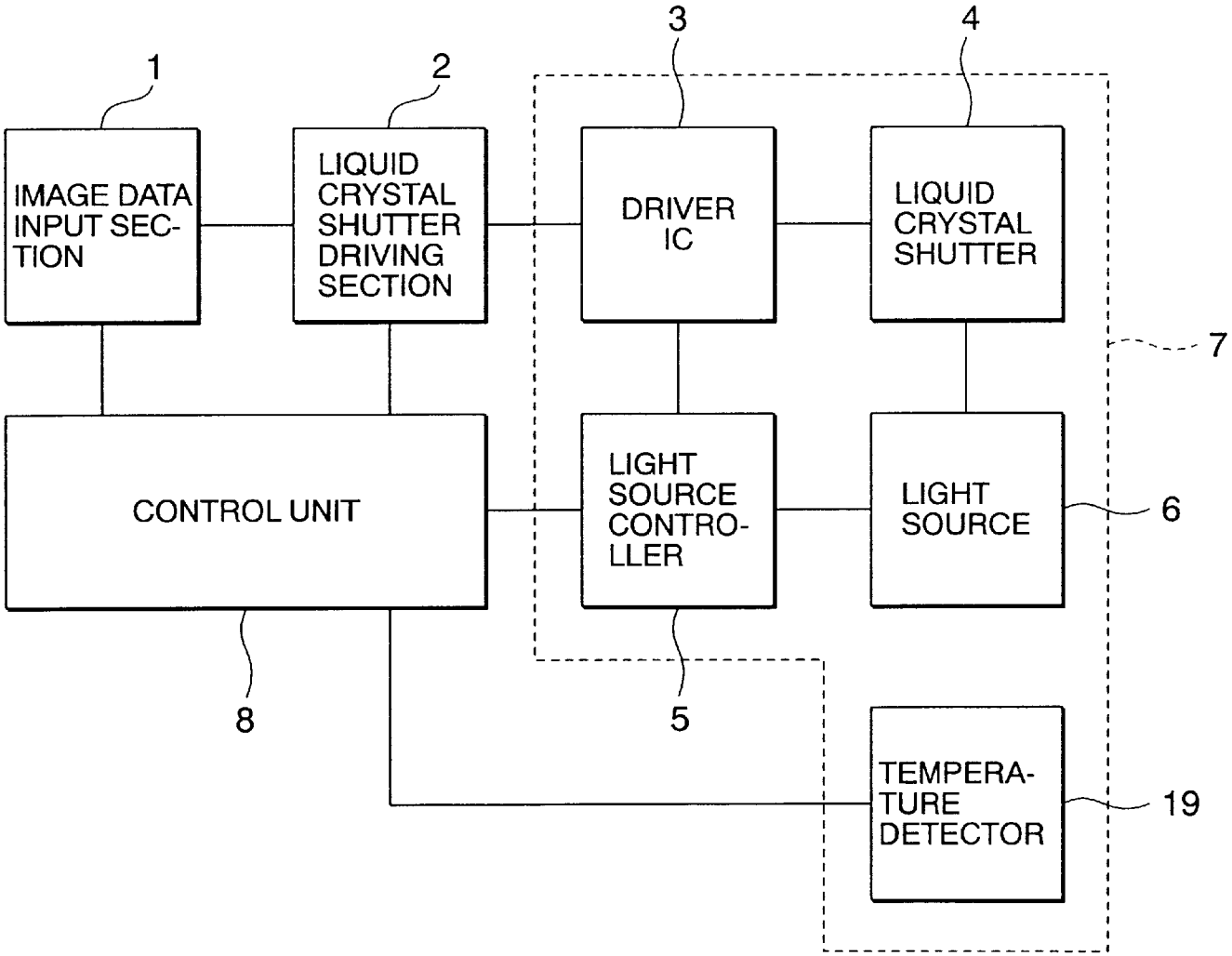
FIG. 9 is a block diagram which shows the construction of a further liquid crystal control device according to the present invention.

For instance, as shown in FIG. 9, (1) a temperature detector 19 is provided in the neighborhood of the print head 7 or inside the liquid crystal driving unit for detecting the environmental temperature or the temperature of the print head 7 itself); (2) the result of the temperature detection is input to the control unit 8; and (3) the delay time is adjusted according to the characteristic of the liquid crystal.

With such a construction, it is possible to achieve a recording apparatus capable of recording high-quality pictures without being influenced by the ambient temperature and the like.

Embodiment 2.

Although in the embodiment 1, the timing of turning on the light source is delayed with respect to the timing of changing the liquid crystal shutter into the transparent or reflection mode, this embodiment 2 is constructed such that the timing of turning off the light source is delayed with respect to the timing of changing the liquid crystal shutter into the blocking or interception mode.

Figures 7A, 7B, 7C, 7D, 7E, 7F, 7G:
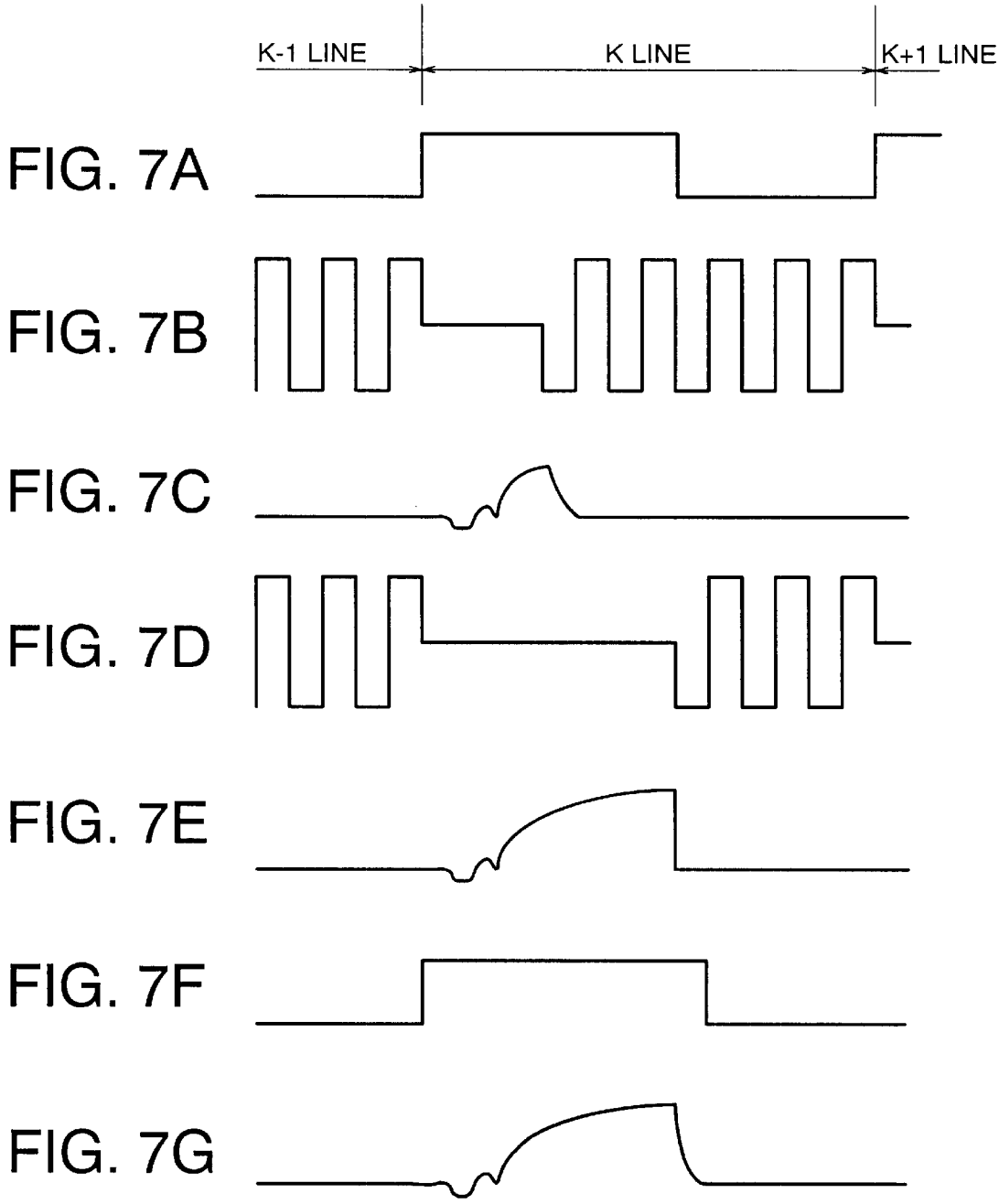
FIGS. 7A through 7G are explanatory views illustrating another exposure method of the liquid crystal control device according to the present invention.

FIGS. 7A through 7G are explanatory views illustrating another exposure method of the present invention, as in FIGS. 3A through 3D. FIG. 7A shows the waveform of an on/off signal of the light source 6. FIG. 7B shows a crystal shutter element driving voltage waveform or the waveform of a voltage imposed on a liquid crystal shutter element which performs an exposure of a relatively short time (e.g., corresponding to a piece of image data having a small value). FIG. 7C shows a light quantity characteristic with the driving waveform of FIG. 7B. FIG. 7D shows a liquid crystal shutter driving voltage waveform or the waveform of a voltage imposed on a liquid shutter element which performs an exposure of a maximum time (e.g., corresponding to the greatest vale of 255 in the case of a piece of image data having a 256-level gradation). FIG. 7E shows a light quantity characteristic with the driving waveform of FIG. 7D.

Here, note that FIG. 7C and FIG. 7E are the light quantity characteristics representative of the quantity of light passing through the liquid crystal in the case where the timing of changing the liquid crystal shutter elements into the blocking mode is matched to the timing of turning off the light source 6.

In general, the on-response time of a liquid crystal upon application of a voltage thereto is several micro seconds—several hundreds microseconds though the on/off response characteristic of the liquid crystal is shorter upon application of a voltage thereon than upon removal of a voltage therefrom. Accordingly, the on/off response characteristic of the light source 6 is by far faster than that of the liquid crystal. In other words, though the light source 6 rapidly turns into an off state, the liquid crystal gradually changes into the blocking state while slowly passing through a transient state.

Therefore, when the timing at which the liquid crystal shutter element remaining in the transparent mode up to the 256th level gradation turns into the blocking mode is matched to the timing at which the light source 6 is turned off, the light source 6 is rapidly turned off before the liquid crystal has turned into a full blocking state. As a result, the light quantity characteristic of the light passing through the liquid crystal becomes as illustrated in FIG. 7E, so that when exposures are made up to the 256th gradation level, a part of the waveform of the light quantity characteristic is lacking and hence the light quantity characteristic becomes distorted in comparison with the other gradation level. Especially, there arises a problem that the exposure characteristic in the case of a long exposure time becomes distorted, causing a deterioration in the picture quality. This is not a problem when a halogen lamp, which has a slow on/off response characteristic, is used as the light source 6, but becomes problematic with a light source having a fast on/off response characteristic. When the light source 6 is controlled to turn on and off for each line, this influence is caused on each line, so the deterioration in the picture quality becomes more remarkable.

Thus, the timing of turning off the light source 6 is controlled as shown in FIG. 7G. That is, the timing of turning off the light source 6 is delayed with respect to the timing of making the liquid crystal shutter element into the blocking mode in accordance with the characteristic of the liquid crystal. As a consequence, the period in which light is supplied from the light source 6 is extended, so that the delay time during which the liquid crystal shutter is changed from a transparent mode to a complete blocking mode can be absorbed, and the distortion of the exposure characteristic can be improved.

Here, it is be noted that the time of distortion of the exposure characteristic of the liquid crystal varies according to the voltage imposed on the liquid crystal shutter element, the material of the liquid crystal, the environmental temperature, the historical state (e.g., the exposure time of the previous line), etc., and hence the delay time is determined through experiments and calculations. Preferably, the delay time is in the range from several microseconds to several milliseconds or so.

According to the above-mentioned exposure method, the liquid crystal control device shown in FIG. 1 operates as follows.

The image data input to the image data input section 1 is sent to the liquid crystal shutter driving section 2 which generates the data for driving the liquid crystal shutter. The output of the liquid crystal shutter driving section 2 is forwarded, as a clock signal, a latch signal, etc., as shown in FIG. 2, to the driver IC 3 of the print head 7 where a gradation image is formed.

On the other hand, the light source 6 is turned on to illuminate in synchronization with an exposure start signal from the light source controller 5, and it is also turned off in synchronization with an turn-off signal which is generated by the light source controller 5 in a delayed relation with respect to an exposure end signal from the control unit 8.

Figure 8:
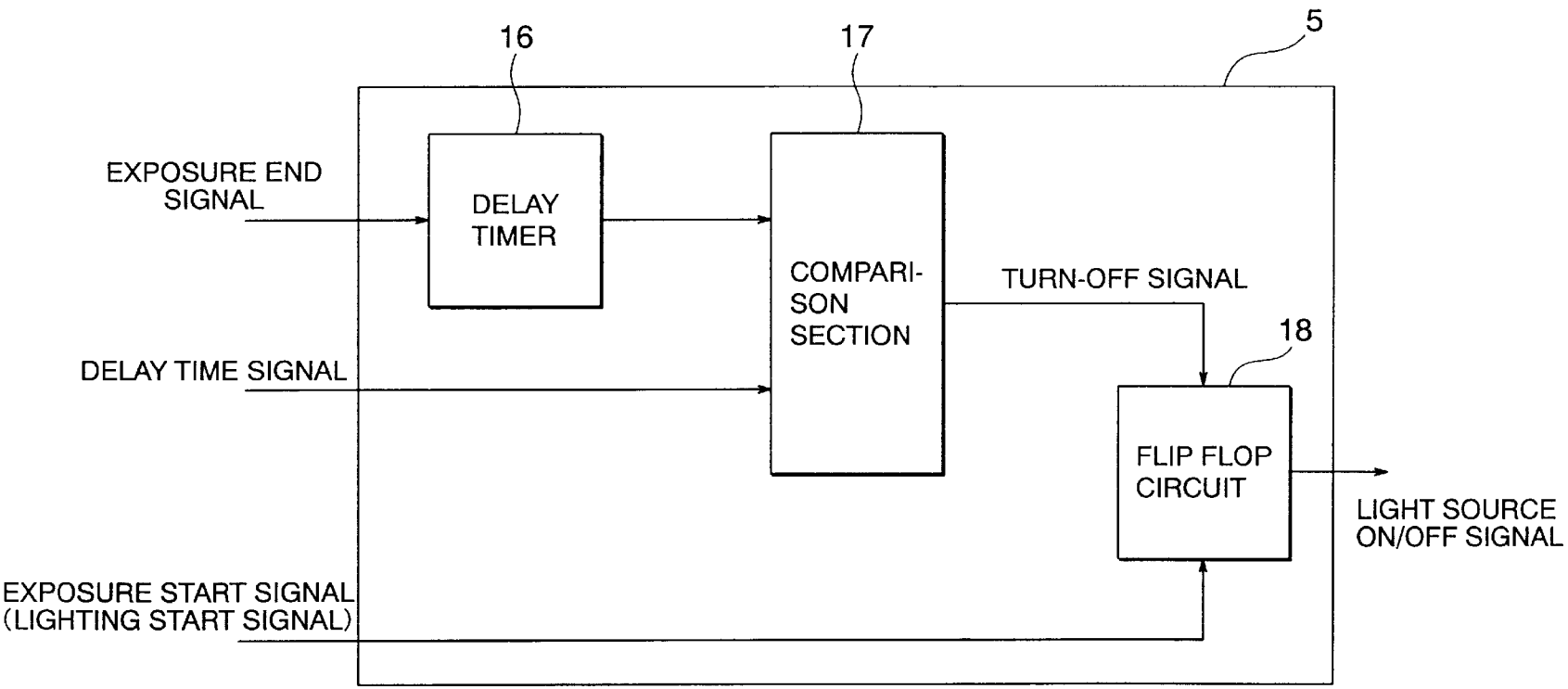
FIG. 8 is a block diagram which shows the construction of another light source controller of the liquid crystal control device according to the present invention.

FIG. 8 is a block diagram illustrating the construction of the light source controller 5 which operates to delay the timing of turning off the light source 6 relative to the timing of making the liquid shutter 4 into the blocking mode. In FIG. 8, a delay timer 16 delays an exposure end signal from the control unit 8. A comparison section 17 compares an output of the delay timer 16 with a delay time signal from the control unit 8. A flip-flop circuit 18 generates an on/off signal for the light source 6 from an output of the comparison section 17 and an exposure start signal from the control unit 8.

The operation of the light source 6 will now be explained while referring to FIG. 8.

When an exposure start signal from the control unit 8 is input to the flip-flop circuit 18, a light source on/off signal output from the flip-flop circuit 18 is changed into an on state, whereby the light source 6 is turned on to illuminate.

In addition, when an exposure end signal from the control unit 8 is input to the delay timer 16, the delay timer 16 is counted up in synchronization with a clock (not shown).

Then, the control unit 8 outputs a delay time signal representative of a prescribed delay time. The delay time signal and an output signal of the delay timer 16 are input to the comparison section 17, and when these signals are matched with each other, the comparison section generates a turn-off signal to the flip-flop circuit 18. As a result, the light source on/off signal output from flip-flop circuit 18 is changed into an off state, whereby the light source 6 is turned off.

In this manner, the formation of the image on one screen is completed by repeating the operations for each line according to the method of delaying the timing, at which the light source 6 is turned off by the light source controller 5, with respect to the timing at which the liquid crystal shutter 4 is de-energized or released by the liquid crystal shutter driving section 2, that is, the timing at which the liquid crystal shutter 4 is turned into a blocking or interception mode.

As described above, this embodiment 2 is constructed such that the timing at which the light source 6 is turned off is delayed with respect to the timing at which the liquid crystal shutter 4 is released or de-energized to turn into the blocking or interception mode. Thus, the following advantages can be provided. The delay time in which the liquid crystal shutter has been changed from a transparent mode to a complete blocking mode can be absorbed. As a result, a stable exposure or display can be achieved to provide high quality recording.

Here, note that in this embodiment 2, various changes or modifications can be made, and thus a color image data storage section may be provided for storing color image data, similar to the various changes or modifications as described in the embodiment 1.

Moreover, for such color image data, there may be used the data corresponding to yellow, magenta and cyanogen.

In addition, the embodiment 1 and the embodiment 2 may be combined without any particular limitations.

In this case, it goes without saying that it is also possible to use one of the delay timers, one of the comparison sections, and one of the flip-flop circuits in FIG. 5 and FIG. 8 to perform the functions of both of these elements.

Further, the light source controller 5 only need be constructed to delay the timing of turning off the light source 6 with respect to the timing of making the liquid crystal shutter 4 into a blocking mode, without any other particular limitations.

Additionally, a construction or mechanism may be added for reducing or eliminating the influence of a liquid crystalline property on a change in an environmental temperature, etc.

For instance, as shown in FIG. 9, (1) a temperature detector 19 is provided in the neighborhood of the print head 7 or inside the liquid crystal driving unit for detecting the environmental temperature or the temperature of the print head 7 itself; (2) the result of the temperature detection is input to the control unit 8; and (3) the delay time is adjusted according to the characteristic of the liquid crystal.

With such a construction, it is possible to achieve a recording apparatus capable of recording high-quality pictures without being influenced by the ambient temperature and the like.

Embodiment 3.

Although in the embodiment 1, the timing of turning on the light source is delayed with respect to the timing of changing the liquid crystal shutter into the transparent or reflection mode, this embodiment 3 is constructed such that the timing of changing the liquid crystal shutter into the transparent or refection mode and the timing of turning on the light source are controlled, and at the same time, the quantity of light of the light source is controlled to increase gradually when the light source is turned on.

Figure 10A:
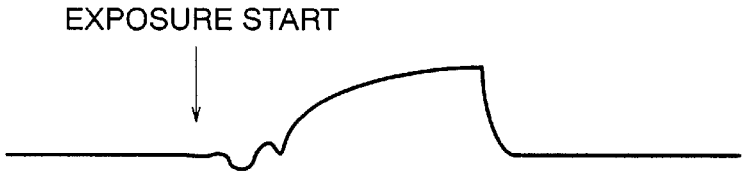
FIGS. 10A through 10E are explanatory views illustrating a further exposure method of the liquid crystal control device according to the present invention.
Figure 10B:
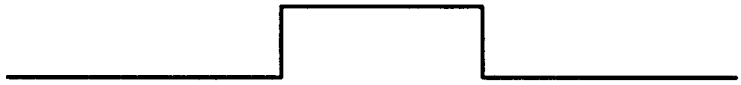

FIGS. 10A through 10E are explanatory views illustrating a further exposure method according to the present invention, as in FIGS. 3A through 3D. FIG. 10A shows a light quantity characteristic corresponding to that of FIG. 3B. FIG. 10B shows an on/off waveform of the light source 6 corresponding to FIG. 3C.

As described above, the state of the liquid crystal immediately after the liquid crystal has been changed from a blocking mode to a transparent mode is unstable, resulting in a light quantity characteristic in which a rising of the waveform is unstable, as shown in FIG. 10A. For this reason, in the embodiment 1, the timing of turning on the light source 6 is delayed, as depicted in FIG. 10B, so that light is supplied from the light source 6 after a period in which the state of the liquid crystal is unstable has passed. However, such control results in a 39 decrease in the total supply of light.

Figure 10C:
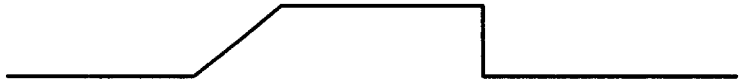
Figure 10D:
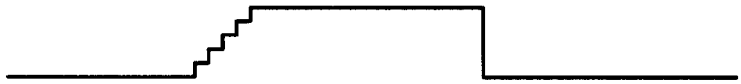
Figure 10E:
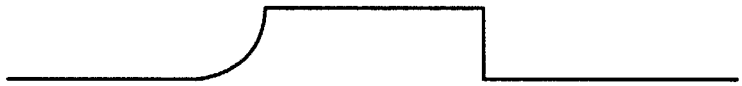

Thus, to avoid such a situation, the quantity of light supplied from the light source 6 is controlled in a manner as shown in FIGS. 10C, 10D and 10E, respectively. That is, in order to decrease the quantity of light supplied from the light source 6 during a period in which the liquid crystal is in an unstable state, the quantity of light of the light source 6 is increased gradually when the light source 6 is turned on. As a consequence, influences in an unstable state of the liquid crystal can be reduced, providing a greater quantity of exposure light (i.e., an improved light quantity characteristic).

Figure 11:
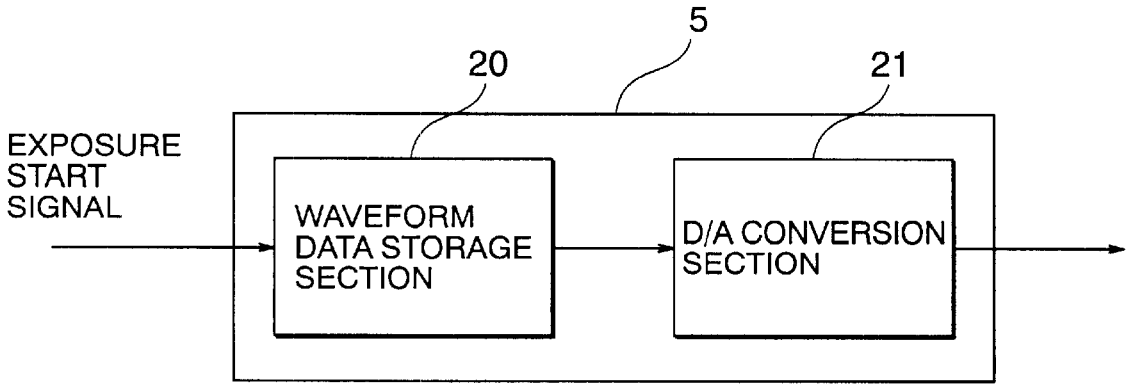
FIG. 11 is a block diagram which shows the construction of a yet further light source controller of the liquid crystal control device according to the present invention.

FIG. 11 is a block diagram illustrating the construction of a light source controller 5 which serves to increase the quantity of light gradually upon the light source 6 being turned on. In FIG. 11, a waveform data storage section 20 stores values representative of on/off waveforms of the light source 6 in the form of a table. A D/A conversion section 21 converts the output of the waveform data storage section 20 into an analog signal. The output of the D/A conversion section 21 is output as an on/off signal for the light source 6.

Next, reference will be made to an operation for turning on the light source 6 with reference to FIG. 11.

The waveform data storage section 20 stores values of waveform data such as, for example, '0', '1', '2', '3'. . . '255', '255', '255', . . . '255', '0' in the case of a waveform having a rising edge increasing linearly at a constant rate, as shown in FIG. 10C. Also, in the case of a waveform having a rising edge increasing stepwise, as shown in FIG. 10D, there are stored values of a waveform data such as '0', '0', '16', '16', '32', '32', . . . , '255', '255', '255', . . . , '255', '0'. In addition, in the case of a waveform having a rising edge increasing along a continuous curve, as shown in FIG. 10E, there are stored values of the waveform data such as '0', '0', '1', '4', '16', '32', . . . , '255', '255', '255', . . . , '255', '0'.

First, the waveform data storage section 20 starts to output the waveform data stored therein in synchronization with a clock (not shown) in a sequential manner upon reception of an exposure start signal from the control unit 8.

Then, the D/A conversion section 21 converts the waveform data into corresponding waveforms, and outputs them as on/off signals for the light source 6.

As a result, when the light source 6 is turned on to illuminate, the quantity of light emitted therefrom is increased gradually.

Thus, the quantity of light from the light source 6 upon turning on thereof is increased gradually according to the values of the waveform data stored in the waveform data storage section 20 of the light source controller 5.

As described above, the timing of driving the liquid crystal shutter 4, i.e., the timing of changing the liquid crystal shutter 4 into the transparent or refection mode, and the timing of turning on the light source 6 are controlled, and the quantity of light of the light source 6 is controlled to increase gradually when the light source 6 is turned on. With such control, a greater amount of exposure light can be obtained while reducing the influence which instability in the state of the liquid crystal gives, thus making it possible to perform high-quality picture recording.

Here, note that in this embodiment 3, various changes, modifications or combinations can be made as referred to in the embodiments 1 and 2.

For instance, the embodiments 2 and 3 may be combined with each other.

Specifically, the quantity of light emitted from the light source 6 may be increased gradually upon turning on thereof, and at the same time, the timing of turning off the light source 6 may be delayed with respect to the timing of making the liquid crystal shutter 4 into a blocking mode.

Moreover, though some examples of on/off waveforms for turning on and off the light source 6 are shown in FIGS.

10C, 10D and 10E, respectively, on/off waveforms are not limited to these exemplary shapes, but any shape of on/off waveform can be employed which is capable of gradually increasing the quantity of light of the light source 6 upon turning of thereof.

In addition, such waveforms may be configured by means of combined circuits, or they may be obtained through calculations by using a digital signal processor (DSP) or the like.

Besides, a driver in the form of a transistor, etc., may be provided at a later stage of the D/A conversion section 21. In this case, an on/off signal is input to any one of the base, the emitter or the collector of the transistor.

Embodiment 4.

Although in the embodiment 3, the timing of changing the liquid crystal shutter into the transparent or refection mode and the timing of turning on the light source are controlled, and at the same time, the quantity of light of the light source is controlled to increase gradually when the light source is turned on, this embodiment 4 is constructed such that the timing of changing the liquid crystal shutter into the transparent or refection mode and the timing of turning on the light source are controlled, and at the same time, the light source is controlled to illuminate in a pulsed manner.

FIG. 12 is an explanatory view illustrating a yet further exposure method according to the present invention, as in FIG. 10. FIG. 12A shows the corresponding a light quantity characteristic corresponding to that of FIG. 3B, as in FIG. 10A. FIG. 12B shows an on/off waveform corresponding to that of the light source 6 of FIG. 3C, as in FIG. 10B.

Figure 12A:
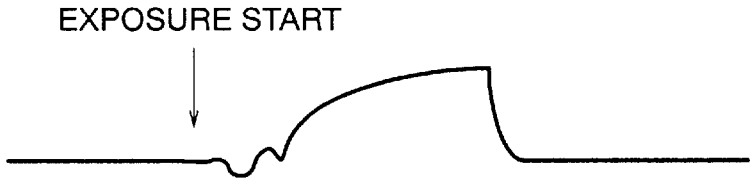
FIGS. 12A through 12D are explanatory views illustrating a yet further exposure method of the liquid crystal control device according to the present invention.
Figure 12B:
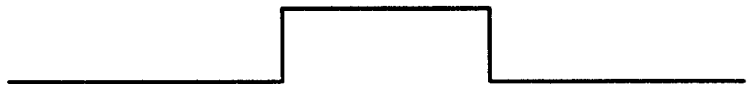

As referred to above, the state of the liquid crystal immediately after having been changed from a blocking mode to a transparent mode is unstable, resulting in a light quantity characteristic in which a rising of the waveform becomes unstable, as illustrated in FIG. 12A. Therefore, in the embodiment 1, the timing of turning on the light source 6 is delayed, as depicted in FIG. 12B, so that light is supplied from the light source 6 after a period in which the state of the liquid crystal is unstable has passed. However, such control results in a decrease in the total supply of light.

Figure 12C:
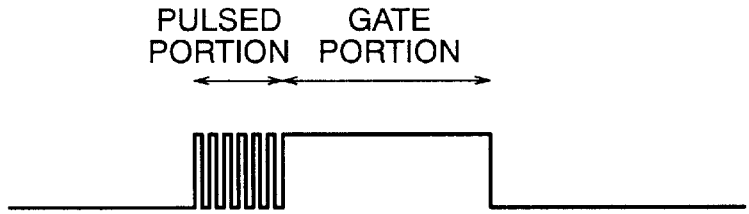
Figure 12D:
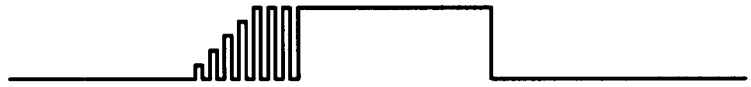

Thus, to avoid such a situation, the quantity of light supplied from the light source 6 is controlled in a manner as shown in FIGS. 12C and 12D, respectively. That is, in order to decrease the quantity of light supplied from the light source 6 during a period in which the liquid crystal is in an unstable state, a pulsed portion is additionally provided for illuminating the light source 6 in a pulsed manner upon turning on thereof. As a result, influences in an unstable state of the liquid crystal can be reduced, providing a greater quantity of exposure light (i.e., an improved light quantity characteristic).

Figure 13:
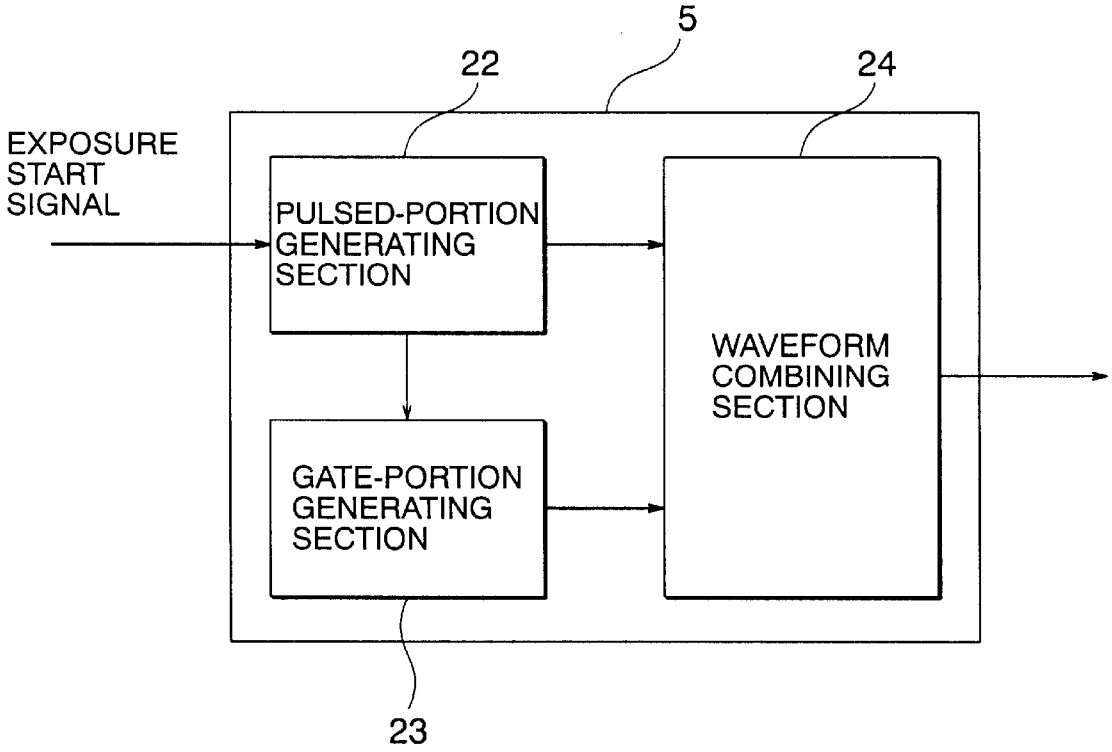
FIG. 13 is a block diagram which shows the construction of a still further light source controller of the liquid crystal control device according to the present invention.

FIG. 13 is a block diagram illustrating the construction of a light source controller 5 which serves to illuminate the light source 6 in a pulsed manner. In FIG. 13, the light source controller 5 includes a pulsed-portion generating section 22 for generating a pulsed portion for a waveform, a gate-portion generating section 23 for generating a gate portion for a waveform, a waveform combining section 24 for combining the pulsed portion and the gate portion with each other.

Now, reference will be made to an operation for illuminating the light source 6 with reference to FIG. 12 and FIG. 13.

First, the pulsed-portion generating section 22 outputs, upon reception of an exposure start signal from the control unit 8, a pulsed waveform such as, for example, one shown in FIG. 12C, to the waveform combining section 24 in synchronization with a clock (not shown). The waveform combining section 24 outputs the pulsed waveform as an on/off signal for the light source 6.

After a prescribed pulse waveform is output by the pulsed-portion generating section 22, the gate-portion generating section 23 is triggered by an end signal from the pulsed-portion generating section 22 to generate a gate waveform to the waveform combining section 24, which then outputs the gate waveform as an on/off signal for the light source 6.

As a result, the light source 6 is operated to illuminate in a pulsed manner when being turned on.

In this manner, the light source 6 is controlled, when turned on, to emit light in a pulse-like manner in accordance with a pulsed waveform generated by the pulsed-portion generating section 22 of the light source controller 5.

As described above, the timing of driving the liquid crystal shutter 4, i.e., the timing of changing the liquid crystal shutter into the transparent or refection mode, and the timing of turning on the light source are controlled, and at the same time, the light source is operated to illuminate in a pulse-like manner. With this control, a greater amount of exposure light can be obtained while reducing the influence which instability in the state of the liquid crystal gives, thereby enabling high-quality picture recording.

Note that in this embodiment 4, various changes, modifications or combinations can be made as referred to in the embodiments 1 through 3.

For instance, the waveform combining section 24 may be constructed as a selector which selects either one of the outputs of the pulsed-portion generating section 22 and the gate-portion generating section 23, instead of combining them.

Also, the light source controller 5 may be configured into a construction as shown in FIG. 11, for generating a pulsed waveform in the form of a stepwise pulsed waveform, as shown in FIG. 12D.

Embodiment 5.

Although in the embodiment 1, the timing of turning on the light source is delayed with respect to the timing of changing the liquid crystal shutter into a transparent or reflection mode, this embodiment 5 is an improvement in the aforementioned embodiments 1 through 4. That is, this embodiment 5 is intended to eliminate instability in an exposure characteristic occurring immediately after the liquid crystal stutter is changed to a transparent or reflection mode, by employing an exposure method in any one of the embodiments 1 through 4 and reducing the thickness of the liquid crystal layer in combination.

Concretely, the thickness of the liquid crystal layer of the liquid crystal shutter 4 is specified.

The characteristic (e.g., response) of the liquid crystal changes greatly according to the material forming the liquid crystal and the thickness of the liquid crystal layer.

For instance, the response is worsened by about four times when the thickness of the liquid crystal layer is doubled.

Figure 14:
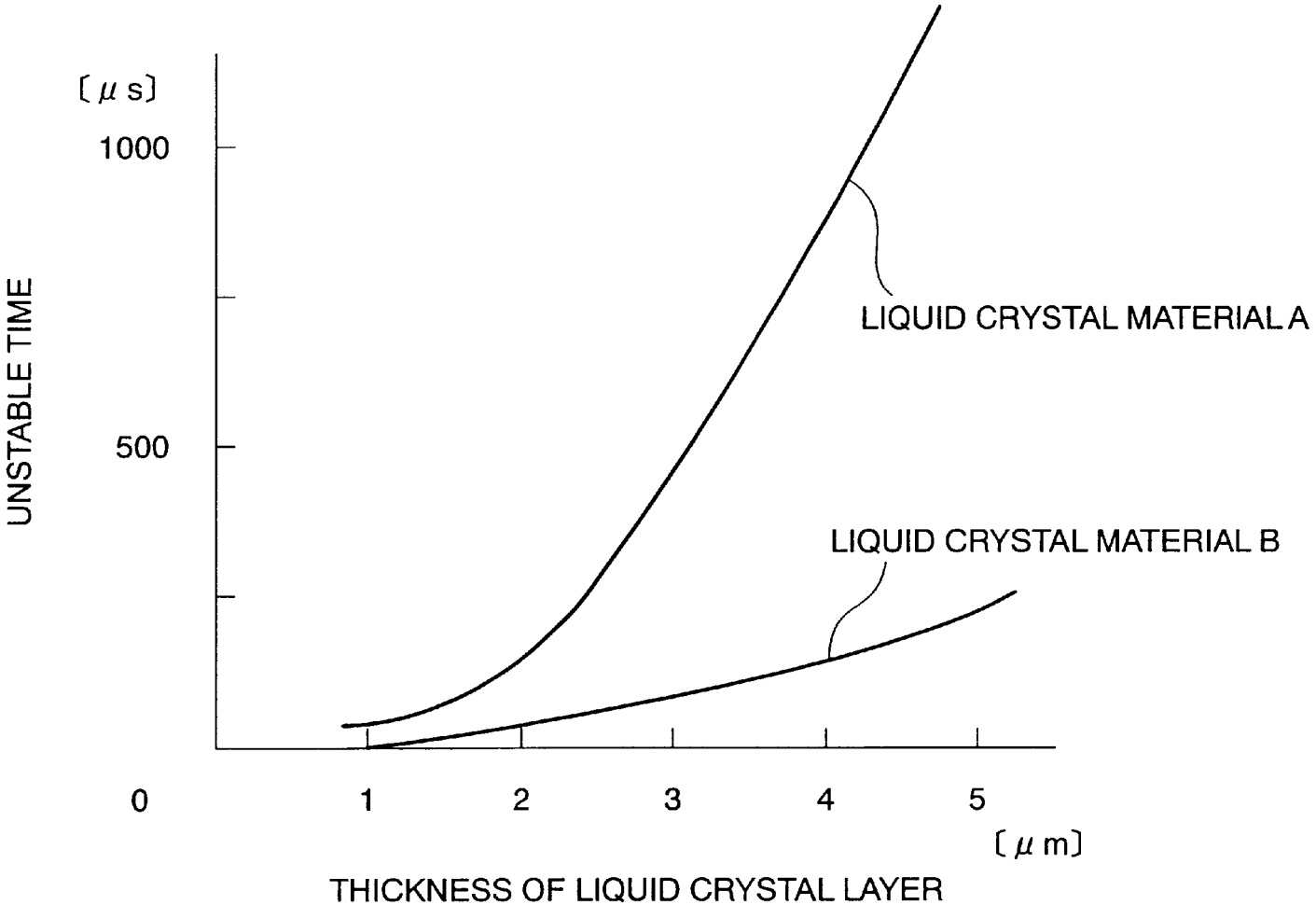
FIG. 14 is a characteristic chart showing a relation between the time of an exposure unstable portion and the thickness of a liquid crystal layer.
Figure 15:
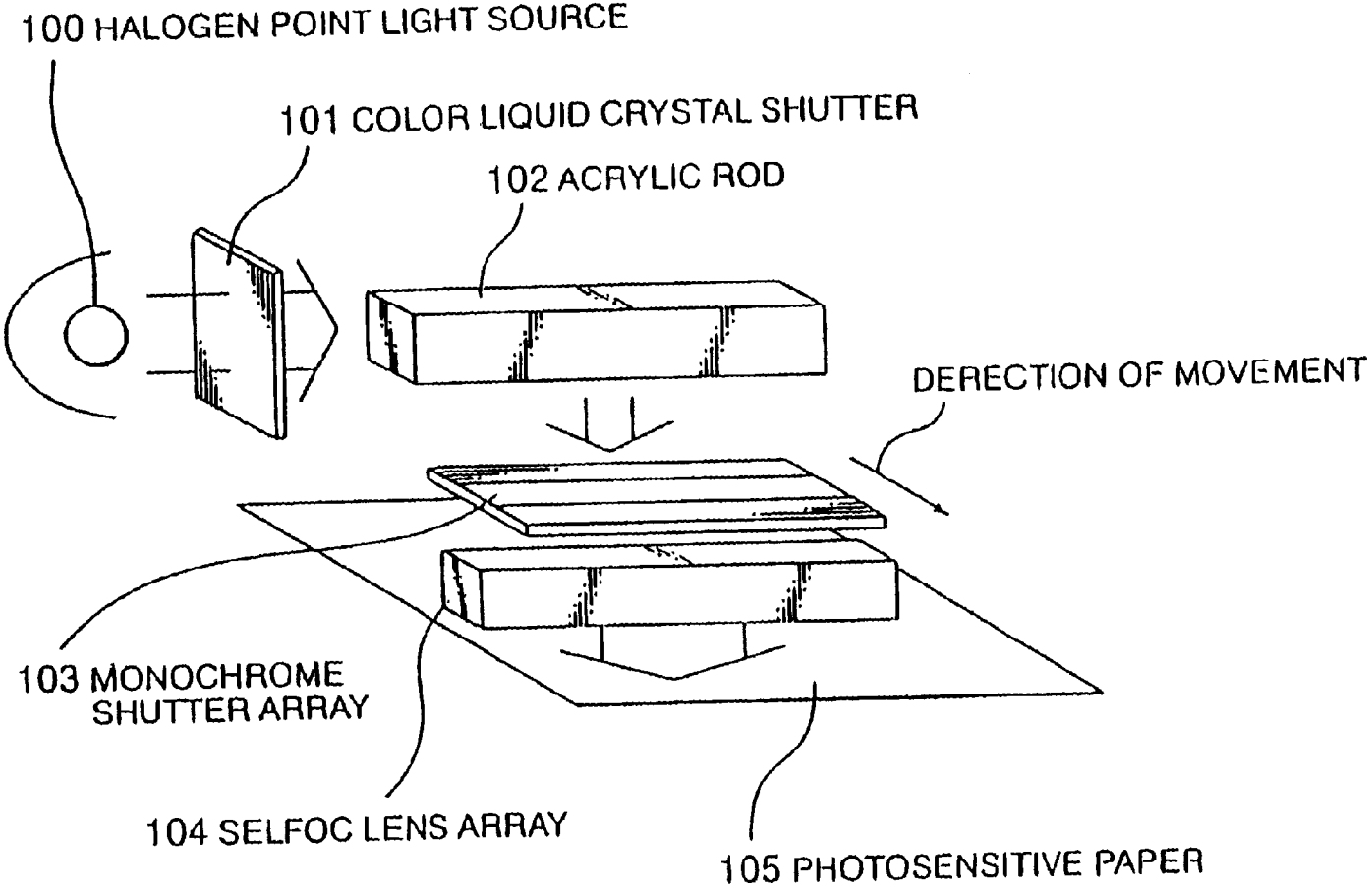
FIG. 15 CONVENTIONAL ART
FIG. 15 is a perspective view which shows the construction of a print head for a conventional liquid crystal drive unit.

FIG. 14 is a characteristic view illustrating a relation between the thickness of a liquid crystal layer and the elapsed time of an exposure instability portion of a liquid crystal which is formed of a typical liquid crystal material.

As is clear from FIG. 14, the thinner the thickness of the liquid crystal layer, the more excellent is the response of the liquid crystal. In particular, a fast response in the range from several $\mu$s to 500 $\mu$s is obtained when the thickness of the liquid crystal layer is 3 $\mu$m or less.

With such a fast response, high-speed recording such as 6 ms/line to 1 ms/line can be obtained. On the other hand, when the thickness of the liquid crystal layer is greater than 3.0 μm, the response characteristic worsens sharply so the rate of recording decreases accordingly.

The operation of the embodiment 5 will now be described while referring to FIG. 1.

The embodiment 5 is substantially similar to the aforementioned embodiments 1 through 4 excepting that the thickness of the liquid crystal layer of the liquid crystal shutter 4 is 3 μm, and hence a similar description is omitted.

First, the exposure characteristic of the liquid crystal shutter 4 immediately after having been changed to the transparent or reflection mode is determined in advance through experiments or calculations, and the delay time for turning on the light source 6, the delay time for turning off the same and/or the time for generating pulsed light are properly set.

It is to be noted that these times change almost by the square of the thickness of the liquid crystal layer, and hence when the thickness of the liquid crystal layer is changed from 5 μm to 3 μm, these times are shortened $3^2/5^2$ times.

The delay time for turning on the light source 6, the delay time for turning off the same and/or the time for generating pulsed light, etc., are stored in the control unit 8, and printing (i.e., exposure) or display is performed, as in the embodiment 1.

As discussed above, according to this embodiment 5, since the thickness of the liquid crystal layer of the liquid crystal shutter is 30 μm or less, high-speed and high-quality picture recording can be achieved.

Note that the exposure characteristic of the liquid crystal shutter immediately after having been changed to the transparent or reflection mode is determined based on the thickness of the liquid crystal layer of the liquid crystal shutter through experiments or calculations, and the delay time for turning on the light source, the delay time for turning off the same and/or the time for generating pulsed light are properly set.

Moreover, in this embodiment 5, various changes, modifications or combinations as referred to in the aforementioned embodiments 1 through 4 can be made.

In cases where a positive type TN liquid crystal is used as the liquid crystal in the various changes, modifications or combinations as referred to in the embodiments 1 through 5, it is possible to form a gradation image which has a high contrast ratio, a fast response speed of the liquid crystal, a low driving voltage, and stable shock resistance.

ADVANTAGES OF THE INVENTION

According to a liquid crystal control device related to one aspect of the present invention, a timing, at which a light source is turned on by a light source controller, is delayed by a control unit with respect to a timing, at which a liquid crystal is driven to operate by a liquid crystal driving section. With this control, the influence caused by a change of the operating mode of the liquid crystal can be eliminated, thus providing a stable exposure or display.

According to a liquid crystal control device related to one aspect of the present invention, a timing, at which a light source is turned off by a light source controller, is delayed by a control unit with respect to a timing, at which a liquid crystal is driven to operate by a liquid crystal driving section. With this control, the influence caused by a change of the operating mode of the liquid crystal can be avoided, and hence a constant quantity of light can be obtained, thus providing a stable exposure or display.

According to a preferred form of a liquid crystal control device of the present invention, the light source comprises a light emitting type element. This serves to eliminate the influence of a liquid crystal characteristic against a change in the environmental temperature, etc., thus providing a stable exposure and display.

According to a liquid crystal control device related to a further aspect of the present invention, a timing, at which a light source is turned on by a light source controller, and a timing, at which a liquid crystal is driven to operate by a liquid crystal driving section, are controlled by a control unit, and at the same time, a quantity of light emitted by the light source is controlled to gradually increase when the light source is turned on. Thus, the influence caused by a change of the operating mode of the liquid crystal can be alleviated, thus providing a greater quantity of exposure light.

According to a liquid crystal control device related to a still further aspect of the present invention, a timing, at which a light source is turned on by a light source controller, and a timing, at which a liquid crystal is driven to operate by a liquid crystal driving section, are controlled by a control unit, and at the same time, the light source is controlled, when turned on, to emit light in a pulsed manner. Accordingly, the influence caused by a change of the operating mode of the liquid crystal can be reduced, thus providing a greater quantity of exposure light.

According to another preferred form of a liquid crystal control device of the present invention, the light source comprises a light emitting type element. Thus, a fast on/off response characteristic can be obtained.

According to a preferred form of a liquid crystal control device of the present invention, the thickness of a liquid crystal layer of the liquid crystal is 3.0 μm or less. This serves to provide a fast liquid crystal characteristic (e.g., fast response), thus achieving high-speed and high-quality picture recording.

According to a further preferred form of a liquid crystal control device of the present invention, the liquid crystal comprises a positive type TN liquid crystal. Thus, a gradation image can be formed which has a fast response speed of the liquid crystal, a low drive voltage, and stable shock resistance.

What is claimed is:

1. A liquid crystal control device comprising:

a light source controller for controlling the turning on and off of a light source by comparing a delay time signal and a delayed exposure start signal;

a liquid crystal driving section for driving a liquid crystal; and a control unit for delaying a first timing corresponding to said delayed exposure start signal, at which said light source is turned on and/or turned off by said light source controller, with respect to a second timing, at which said liquid crystal is driven to operate by said liquid crystal driving section.

2. The liquid crystal control device according to claim 1, wherein said control unit adjusts said timing, at which said light source is turned on by said light source controller, according to a temperature characteristic of said liquid crystal.

3. The liquid crystal control device according to claim 1, wherein said light source comprises a light emitting type element.

4. The liquid crystal control device according to claim 1, wherein the thickness of a liquid crystal layer of said liquid crystal is 3.0 μm or less.

5. The liquid crystal control device according to claim 1, wherein said liquid crystal comprises a positive type TN liquid crystal.

6. A liquid crystal control device comprising:

a light source controller for controlling the turning on and off of a light source;

a liquid crystal driving section for driving a liquid crystal; and a control unit for controlling a first timing, at which said light source is turned on by said light source controller, and a second timing, at which said liquid crystal is driven to operate by said liquid crystal driving section; wherein said light source controller controls said light source in such a manner that a quantity of light emitted by said light source gradually increases when said light source is turned on.

7. The liquid crystal control device according to claim 6, wherein said light source comprises a light emitting type element.

8. The liquid crystal control device according to claim 6, wherein the thickness of a liquid crystal layer of said liquid crystal is 3.0 $\mu$m or less.

9. The liquid crystal control device according to claim 6, wherein said liquid crystal comprises a positive type TN liquid crystal.

10. A liquid crystal control device comprising:

a light source controller for controlling the turning on and off of a light source by comparing a delay time signal and a delayed exposure start signal;

a liquid crystal driving section for driving a liquid crystal; and a control unit for controlling a first timing corresponding to said delayed exposure start signal, at which said light source is turned on by said light source controller, and a second timing, at which said liquid crystal is driven to operate by said liquid crystal driving section;

wherein said light source controller controls said light source in such a manner that said light source emits light in a pulsed manner when turned on.

11. The liquid crystal control device according to claim 10, wherein said light source comprises a light emitting type element.

12. The liquid crystal control device according to claim 10, wherein the thickness of a liquid crystal layer of said liquid crystal is 3.0 $\mu$m or less.

13. The liquid crystal control device according to claim 10, wherein said liquid crystal comprises a positive type TN liquid crystal.

14. A method for controlling a liquid crystal, comprising the steps of:

delaying a first timing with respect to a second timing, wherein said second timing correlates to an operating time for shutter elements of said liquid crystal;

comparing signals related to said first timing and said second timing; and operating a light source to supply light to said liquid crystal in accordance with said signals.

15. The method of claim 14, further comprising gradually increasing a quantity of said light when said light source is activated.

16. The method of claim 14, further comprising receiving an exposure end signal at a flip-flop circuit to turn off said light source.

* * * * *